United States Patent [19]

Ohnishi

[11] 4,218,196

[45] Aug. 19, 1980

[54] MOTOR FUEL PUMP

[75] Inventor: Shunsaku Ohnishi, Toyota, Japan

[73] Assignee: Nippondenso Co., Ltd., Kariya, Japan

[21] Appl. No.: 964,793

[22] Filed: Nov. 28, 1978

[30] Foreign Application Priority Data

Dec. 5, 1977 [JP] Japan ..... 52-163077[U]

[51] Int. Cl.[2] ..... F04B 17/00; F04B 35/04

[52] U.S. Cl. ..... 417/424; 417/366; 417/435

[58] Field of Search ..... 417/435, 424, 366, 422

[56] References Cited

U.S. PATENT DOCUMENTS 3,507,582 4/1970 Jeep ..... 417/424 X 3,877,845 4/1975 Green et al. ..... 417/424

4,013,383 3/1977 Rule ..... 417/366

*Primary Examiner*—Richard E. Gluck

*Attorney, Agent, or Firm*—Cushman, Darby & Cushman

[57] ABSTRACT

A motor fuel pump comprises a motor unit, a pump unit and a common driving shaft. The pump housing of the pump unit has a frustum-shaped ceiling with a central opening at the top thereof. The pump impeller has a flat member to which a plurality of outwardly extending blades are secured. Since the central opening of the frustum-shaped ceiling is approximately equal to the fringe of the flat member and opens therebove, vapor generated from the fuel in the pump housing is readily evacuated from the pump housing and cavitation may be prevented.

1 Claim, 5 Drawing Figures

MOTOR FUEL PUMP

BACKGROUND OF THE INVENTION

The present invention relates to an improvement in a motor pump immersed in a fuel tank of an automobile, in particular, to an improved structure to prevent cavitation of a centrifugal pump used in high temperature circumstances or in high mountainous areas.

It has been generally experienced that when driving in a very hot area, or mountainous area higher than 2,000 meters, a great deal of vapor is sometimes generated from the central portion of a centrifugal pump impeller and filled in the pump housing so that pumping action is not made effectively due to cavitation.

SUMMARY OF THE INVENTION

The present invention is to provide an improved motor fuel pump which is operable even in a very hot area or high mountainous area. For this purpose, the motor housing is provided with a frustum-shaped ceiling having a central opening the diameter of which is approximately equal to that of the circle on which the inner edges of impeller blades of the centrifugal pump lie.

Other object and features of the present invention will be apparent from the following description and drawings.

DESCRIPTION OF THE PREFERRED EMBODIMENT

Figure 1:
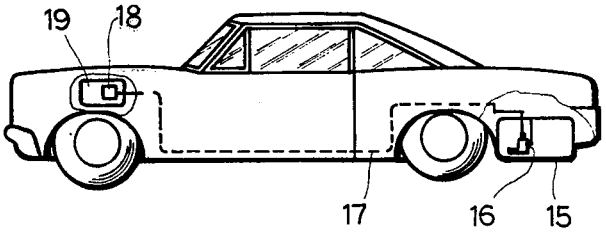
FIG. 1 is a schematic diagram showing location of a motor fuel pump in a vehicle.
Figure 2:
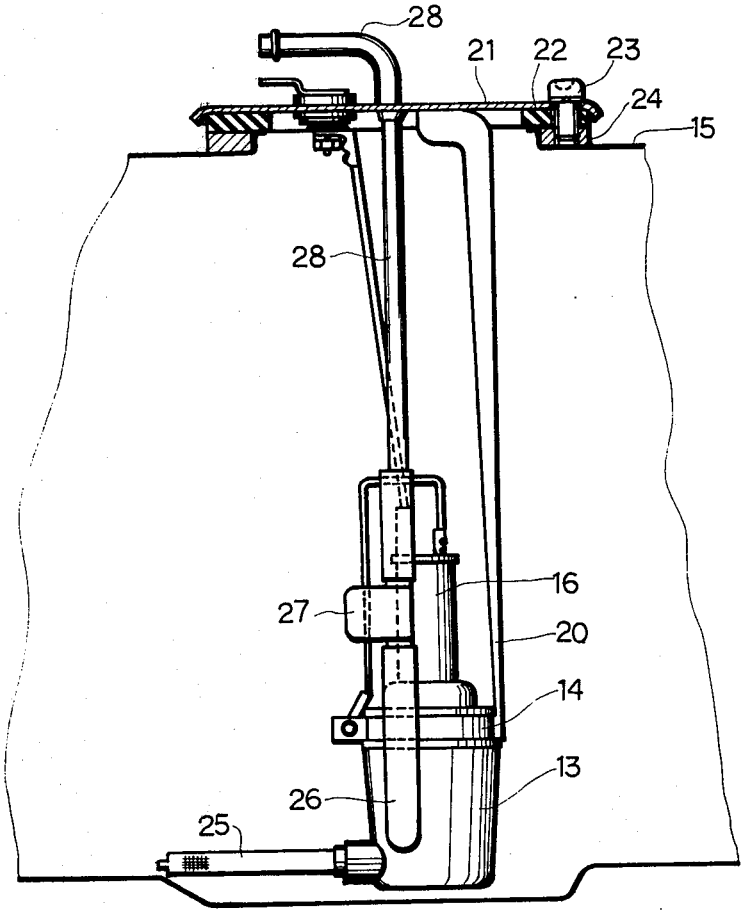
FIG. 2 is a partially sectional front view of mounting of a motor fuel pump in a fuel tank.

In FIG. 1, a motor fuel pump 16 of the present invention is mounted in a fuel tank 15 to supply fuel through a fuel supply pipe 17 to a carburetor 18 of an engine 19. As shown in FIG. 2, the pump 16 is secured to a cover plate 21 of the fuel tank 15 by means of brackets 14 and 20. The cover plate 21 is in turn secured to a metal ring 24 of the tank 15 through packing 22 by screws 23. Fuel is sucked through a fuel strainer 25 by the pump 16 and driven thereout under pressure through a rubber tube 26, a pressure regulator 27, and an outlet pipe 28 to the fuel supply pipe 17.

Figure 3:
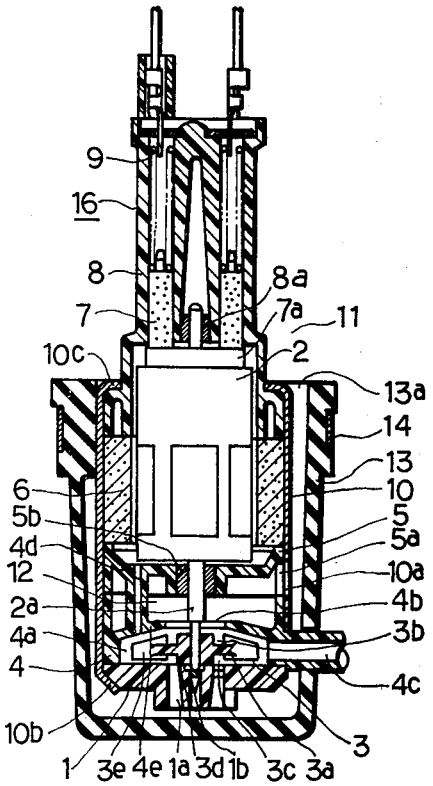
FIG. 3 is a sectional front view of an embodiment according to the present invention.
Figure 4:
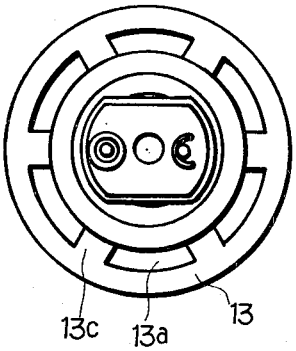
FIG. 4 is a plan view of the embodiment shown in FIG. 3
Figure 5:
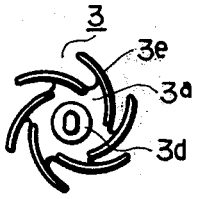
FIG. 5 is a plan view of a centrifugal pump impeller used in the embodiment shown in FIG. 3.

In FIG. 3, a bottom member 1 of a pump housing 4 has a pump inlet 1*a* and a pin-shaped thrust bearing 1*b* for retaining axial movement of the armature shaft 2*a* of an armature 2. A centrifugal pump impeller 3 has a center boss 3*d* secured to the armature shaft 2*a* and a plurality of blades 3*e* evenly disposed in a circumference on a flat member 3*a* and secured thereto as shown in FIG. 5. The flat member 3*a* partly divides the pump chamber 4*a* into upper and lower portions 3*b* and 3*c* in the central portion of the pump housing 4. The pump housing 4 also has a frustum-shaped ceiling member 4*e* at the top with a central opening 4*b* opened right above the impeller 3, a fuel outlet 4*c* connected to the ruber tube 26 and a fuel passage 4*d* opened to the inside of a motor unit, which will be hereinafter described. The diameter of the central opening 4*b* is approximately equal to that of the flat member of the impeller 3*a*, in other words, the diameter of the circle on which the inner edge of the impeller blades lie.

The motor comprises an end housing 5, permanent magnets 6, brushes 7, a brush holder 8, coil springs 9, a motor housing 10 and the armature 2 as well as the shaft 2*a*. The end housing 5 has a cylindrical wall with an aperture or apertures 5*a* formed thereon and a bearing 5*b* for one end of the armature shaft 2*a*. The open end of the fuel passage 4*d* is also fluid tightly secured to the end housing 5. The permanent magnets 6 are secured to the inner surface of the motor housing between the end housing 5 and the brush holder 8 to provide a magnetic field in a known manner. The brush holder 8 is located on the top of the pump 16 and has a bearing for carrying the other end of the shaft 2*a* and a couple of elongating holes in which the brushes and coil springs 9 are respectively retained. The coil springs exerts their force via the brushes 7 on a commutator 7*a* and, in turn, to the armature 2 and armature shaft 2*a* in its axial direction thus retaining the axial movement of the armature shaft. The coil springs 9 also electrically connect the brushes with electric terminals from which electric energy is supplied. The motor housing 10 grips the brush holder 8 and bottom member 1 by bends 10*c* and 10*b* formed at the opposite ends to incorporate motor components such as the brush holder 8, end housing 5 and pump housing 4 in a unit as shown in FIG. 3. The side wall of the motor housing 10 is formed an opening 10*a* above the central opening 4*b* in alignment with the aperture 5*a* to communicate the space 12 defined between the ceiling member 4*e* of the pump housing 4 and end housing 5 with the outside of the motor housing 10.

A pump cover 13 which encases the whole surface of the motor housing 10 has a vapor relief passage 13*a* between the motor housing 10 and the internal surface of the cover 13 and an annular groove for receiving the bracket 14.

In operation, when the impeller 3 is driven to rotate by the motor unit, fuel is sucked through the inlet 1*a* and through the central opening 4*b* and is driven out of the outlet 4*c* to flow into the carburetor 18 of the engine 19. At the same time, a partial amount of fuel is introduced into the inside of the motor unit through the fluid passage 4*d* to cool the bearings 5*b* and 8*a* and armature 2. The fuel, thereafter, returns to the fuel tank 15 through gaps formed in or around motor components such as the brush holder 8 and bearings 5*b* and 8*a*.

When fuel temperature becomes very high, when the vehicle runs in a very high mountainous area or when fuel having comparatively higher vapor pressure is used, fuel is very likely to vaporize especially from the central portion of the impeller. Since the central opening 4*b* opens at the top of the frustum-shaped ceiling 4*e* of the pump housing right above the impeller 3 and extends to reach the inner edges of the blades 3*e*, the vapor generated from the central portion of the impeller goes up and is readily evacuated therefrom to the atmosphere through the central opening 4*b*, side apertures 5*a* and 10*a*, vapor relief passage 13*a* and fuel tank 15. Since the ceiling 4*e* is shaped into a frustum cone, fuel vapor generated any other portions may be guided to the central opening.

It has been found that the fuel under the flat member 3*a* does not contain a great deal of vapor so that normal pumping may be maintained in any condition. The fuel supply pressure in the condition where the vaporization takes place may be changed by changing the axial position of the flat member 3*a* relative to the blades 3*e*.

What is claimed is:

1. A motor fuel pump comprising:

a cup-shaped cover with its open end on top a cylindrical motor housing of magnetic material secured into said cover with its axis in alignment with the axis of said cover;

a brush holder having electric terminals, brushes, springs and a first bearing and secured to said motor housing at the top portion thereof;

an armature disposed beneath said brush holder and having a shaft carried by said bearing at its one end and a commutator in contact with said brushes;

permanent magnets secured to said motor housing around said armature;

an end housing secured to said motor housing for defining a motor unit, said end housing having a second bearing for carrying the other side of said shaft;

a pump housing disposed at the bottom of said motor housing and having a frustum-shaped ceiling member, a bottom member with a fuel inlet and a fuel outlet extending out of said cover, said ceiling member having a central opening opened at the top thereof;

a centrifugal pump impeller carried by said shaft and disposed in said pump housing below said central opening to be rotated by the motor unit and having a center boss connected to said shaft, a plurality of axially and outwardly extending blades evenly disposed in a circumference and a flat member for securing said center boss and blades, the diameter of the inner periphery of said blades being approximately equal to that of said central opening;

said cup-shaped cover and motor housing having apertures and passages formed above said central opening thereby communicating the inside of the pump housing and the atmosphere through said central opening.

* * * * *